United States Patent [19]

Curtinot et al.

[11] 4,380,747

[45] Apr. 19, 1983

[54] TUNABLE ULTRA-HIGH FREQUENCY FILTER WITH VARIABLE CAPACITANCE TUNING DEVICES

[75] Inventors: Jean C. Curtinot; Xavier Delestre; Jean Fouillet, all of Paris, France

[73] Assignee: Thomson-CSF, Paris, France

[21] Appl. No.: 237,997

[22] Filed: Feb. 25, 1981

[30] Foreign Application Priority Data

Mar. 4, 1980 [FR] France ..... 80 04833

[51] Int. Cl.[3] ..... H01P 1/207; H01P 1/00

[52] U.S. Cl. ..... 333/202; 333/209; 333/253

[58] Field of Search ..... 333/202, 206–212, 333/226, 227–230, 231, 232, 235, 234, 253

[56] References Cited

U.S. PATENT DOCUMENTS

| | | | |
|---|---|---|---|
| 2,085,223 | 6/1937 | Kolster | 333/235 X |
| 2,645,679 | 7/1953 | Reade | 333/202 X |
| 3,273,083 | 9/1966 | Rose | 333/203 |
| 3,336,542 | 8/1967 | Hancock | 333/226 |
| 3,444,485 | 5/1969 | Okean | 333/207 |
| 3,480,889 | 11/1969 | Kach | 333/229 |
| 3,618,135 | 11/1971 | Weller | 333/232 |
| 3,733,567 | 5/1973 | Johnson | 333/234 |
| 3,737,816 | 6/1973 | Honicke | 333/212 |
| 4,001,737 | 1/1977 | Scott | 333/232 |

FOREIGN PATENT DOCUMENTS

| | | |
|---|---|---|
| 2412759 | 9/1975 | Fed. Rep. of Germany . |
| 762304 | 4/1934 | France . |
| 880808 | 4/1943 | France . |
| 1046593 | 12/1953 | France . |
| 2149130 | 3/1973 | France . |
| 1163896 | 9/1969 | United Kingdom . |
| 2006539 | 5/1979 | United Kingdom . |

*Primary Examiner*—Marvin L. Nussbaum
*Attorney, Agent, or Firm*—Roland Plottel

[57] ABSTRACT

The invention relates to ultra-high frequency filters with variable capacitance tuning devices tunable in a wide frequency range.

Each tuning device comprises two coaxial fingers, namely a fixed finger and a finger movable in the filter body. One of these fingers is hollow and the other has a tuning plunger, whose end is cylindrical and which is displaceable, e.g. by screwing in the body of the finger. The minimum capacitance obtained with a minimum penetration of the plunger, its end being level in the vicinity of the end of the corresponding finger, is adjustable by displacing the movable finger relative to the fixed finger. The supplementary variable capacitance is obtained by plunging the tuning plunger into the hollow finger.

9 Claims, 5 Drawing Figures

TUNABLE ULTRA-HIGH FREQUENCY FILTER WITH VARIABLE CAPACITANCE TUNING DEVICES

BACKGROUND OF THE INVENTION

The invention relates to the field of frequency-tunable ultra-high frequency filters with variable capacitance tuning devices.

In general terms transmission systems and particularly telecommunications systems are designed to operate in a given frequency band which may have several channels and the ultra-high frequency filters of the system must be tuned to the desired channel. When the system is intended to operate on the fixed frequency channel the filters can be adjusted in the factory or during their installation in a final manner. However, when the system is intended to successively operate on several frequency channels the so-called "frequency-mobile" filters must be able to rapidly and simply pass from one channel to another. In all cases it is necessary to provide tuning means for the ultra-high frequency filters used. The smaller the number of components to be varied and the less their setting influences the characteristics of the filter, other than the tuning frequency, the easier said tuning can be performed.

At present a number of different types of ultra-high frequency filters are used. Thus, there are filters whose resonators are line sections, whereas in others these components are in wave guide form. The most commonly used filters with resonators in a TEM line are interdigitated filters with quarter wave resonators and comb filters with resonators, charged by localized capacitive elements forming obstacles. Resonator filters in wave guides are differentiated according to their operating mode. When they operate in the propagation mode, i.e. above the cut-off frequency of the guide, the most commonly used is the half-wave resonator filter of the series type coupled by inductance. When they operate in the evanescent mode, i.e. at a frequency below the cut-off frequency of the guide they are constructed as parallel resonators coupled by admittance inverters and they then have localized capacitive obstacles.

These filters are tuned by varying the shape of the localized inductive or capacitive obstacles associated with the TEM lines or the wave guides for forming the filter.

The invention specifically relates to filters incorporating localized capacitive obstacles.

The presently used capacitive tuning devices are usually constructed by means of metal plungers which penetrate the guide or line and the capacitance is regulated by varying the plunger penetration. The variation of the inductance of the capacitive element (linked with the variation of the tuning frequency) obtained in this way, as a function of the frequency, is dependent on the physical configuration of said element and of the cross-section of the guide or line. However, in general terms the variation law of the tuning frequency, as a function of the plunger displacement is not linear. Moreover, in filters in the evanescent mode, the dimensions of the guide in the plane orthogonal to the propagation axis are less than the wavelength corresponding to the cut-off frequency of the guide. Therefore the localized capacitance necessary for obtaining tuning, which increases as the operating frequency decreases, must be located in a smaller space. The capacitance obtained by means of two facing plungers is increased by reducing the cap separating them. However, beyond a certain limit this gap is too small to be accurately adjusted and in addition temperature variations, due to the expansion of metals caused by them, can create very significant relative variations of this gap. The capacitance can then be increased by increasing the facing surfaces. However, this solution is not always practicable by increasing only the diameter of the plungers, because the volume of said plungers is limited through the small dimensions of the evanescent mode-type filters. Finally, as externally the geometry of the plungers in the guide varies as a function of the capacitance required, linked with the tuning frequency, the change in the tuning frequency of the resonator assembly also affects the coupling of said resonator with adjacent components, adjacent resonators or filter inputs. Coupling variations lead to significant variations in the pass band of the filter and to a deterioration in the input and output impedences of this filter as a function of the tuning frequency.

BRIEF SUMMARY OF THE INVENTION

The present invention relates to a filter having a tuning device with variable capacitance for a wave guide or TEM line, which does not have the disadvantages of the capacitive tuning devices presently used in the ultra-high frequency filters and which in particular makes it possible to obtain an almost linear variation of the tuning frequency as a function of the displacement of the tuning plunger in a given tuning frequency range, the pass band of the filter and the couplings of a resonator member obtained in this way with the adjacent components (adjacent resonator or input) being almost independent of the tuning frequency chosen from the frequency range in which the filter is tunable.

The present invention therefore relates to a tunable ultra-high frequency filter comprising at least one variable capacitance tuning device incorporating two coaxial fingers, the first finger being hollow and the second comprising a plunger which is displaceable relative to the hollow finger between a minimum penetration position where the plunger and hollow finger do not have facing surfaces and a maximum penetration position where the plunger and hollow finger have maximum facing surfaces for determining a capacitance variation, wherein the plunger has a diameter which is much smaller than the external diameter of the hollow finger and wherein the second finger also has a body with at least one cylindrical part of the same diameter as a cylindrical part of the first finger which is intended to face it, said two parts being displaceable relative to one another, the variable distance between the corresponding facing parallel surfaces determining a second fraction of the variable capacitance.

The invention also relates to a tunable ultra-high frequency filter comprising at least one variable capacitance tuning device.

BRIEF DESCRIPTION OF THE DRAWINGS

The invention is described in greater detail hereinafter relative to non-limitative embodiments and the attached drawings, wherein show.

DETAILED DESCRIPTION OF THE PREFERRED EMBODIMENTS

Figure 1:
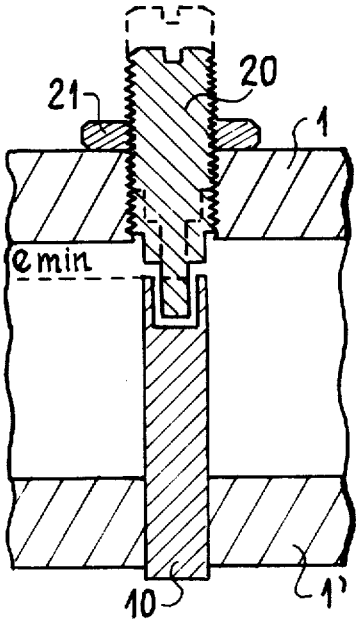
FIG. 1, is a partial cross-sectional view of one embodiment.

In all the drawings the identical components are given the same reference numerals.

FIG. 1 shows the simplest embodiment of the tuning device according to the invention. The device is shown in sectional form positioned in a guide 1, 1'. This guide can be an evanescent mode wave guide of square, rectangular, circular or even ellipsoidal cross-section, but 1–1' can also represent the walls of a TEM line. The capacitive device mainly comprises a metal finger 10 fixed in wall 1' and a threaded movable finger 20, all 1 being tapped. Movable finger 20 can be held in place by a nut 21. Fixed finger 10 and movable finger 20 are interpenetrating, the end of finger 20 forming the tuning plunger. To obtain tuning in a given frequency range $F_{min}$ (minimum frequency of the range) to $F_{max}$ (maximum frequency of the range), the minimum facing surfaces are chosen so that when the end of the movable finger 20 forming the plunger is at minimum penetration $e_{min}$ corresponding to minimum capacitance $C_{min}$, said capacitance is the tuning capacitance for the highest frequency of the range $F_{max}$. This capacitance is essentially dependent on the distance d between the facing surfaces of said minimum penetration $e_{min}$ and the surfaces of the facing fingers. The travel of the end of the movable finger forming plunger 20 and the corresponding height of the cavity formed in fixed finger 10, as well as their respective diameters are chosen so that the maximum capacitance $C_{max}$ corresponds to the minimum frequency $F_{min}$ of the desired tuning frequency range, the facing surfaces of the two plungers then being at a maximum.

In this embodiment it should be noted that the external shape of the tuning device obtained varies a little and that the minimum capacitance $C_{min}$ for the highest frequency of the range not being maintained, the capacitance obtained evolving with the penetration of the plunger.

The embodiments shown in the following drawings are improved. They have a movable finger incorporating a movable body permitting tuning at the high frequency of the tuning range and a small, also movable plunger introducing a variable supplementary capacitance which is added to the minimum capacitance $C_{min}$ corresponding to the minimum penetration of the small plunger, but which does not modify the external shape of the tuning device.

Figure 2:
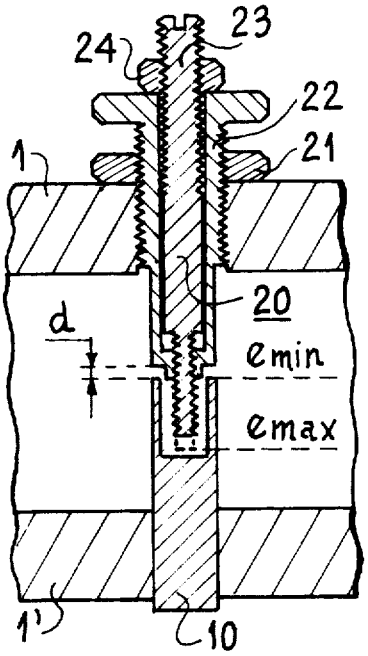
FIG. 2 is a partial cross-sectional view of another embodiment.

The tuning device shown in FIG. 2 comprises a hollow fixed finger 10 and a movable finger incorporating a body 22 movable in wall 1, the movable body being held in position by a nut 21. Body 22 penetrates slightly into the cavity of fixed finger 10. With the said hollow movable body is associated a small movable plunger 23 screwed into body 22, whose penetration can vary between a minimum penetration $e_{min}$, the end of the small movable plunger then being flush with the end of movable body 22 and the thus obtained capacitance being a capacitance $C_{min}$ corresponding to the highest frequency of the tuning range $F_{max}$, and a maximum penetration $e_{max}$, the small plunger then abutting within the body 22 and the thus obtained capacitance being the maximum capacitance $C_{max}$ corresponding to the minimum frequency of the tuning range. The displacement of the small plunger can then be approximately 5 mm to 1 cm in order to cover the tuning range. The distance d between the planar surfaces of the two facing fingers of approximately 5/10 mm is definitively adjusted for the highest frequency of the range and only the small plunger is moved to obtain the tuning frequency variations.

The capacitance variation obtained is such that the tuning frequency varies in an almost linear manner with the penetration. The small plunger 23 is fixed in position by means of a nut 24 bearing against the head of movable body 22.

Figure 3:
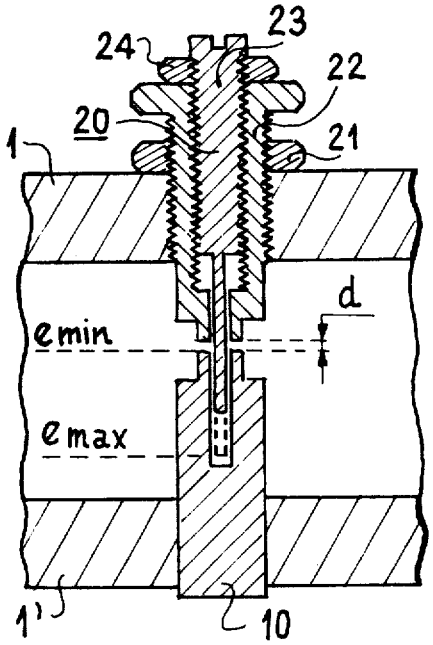
FIG. 3 is a partial cross-sectional view, similar to FIG. 2.

FIG. 3 shows an identical embodiment, but for which the external dimensions of the fingers are large compared with the dimensions of the cylinders used for producing the minimum capacitance and the supplementary variable capacitance added thereto. Fixed finger 10 and the body 22 of the movable finger have tapered ends in such a way that the facing surfaces for obtaining the minimum capacitance $C_{min}$ are relatively small. The movable body 22 does not enter the cavity of fixed finger 10. However, the cavity of fixed finger 10 and the cavity of movable finger body 22 have the same diameter, which is matched to the diameter of the small movable plunger 23. The minimum capacitance $C_{min}$ is adjusted when the plunger 23 is placed in the high position with minimum penetration $e_{min}$ and, as in the embodiment of FIG. 2, the capacitance variation produced by the displacement of the plunger is such that the tuning frequency variation is linear as a function of the plunger displacement. The respective diameters of the cavity of finger 10 and of the plunger are such that the displacement of the plunger makes it possible to cover the desired frequency range. Such an embodiment of the capacitive tuning device has made it possible to cover the tuning frequency range 1.7 to 2.1 GHz in an evanescent mode filter, i.e. relatively high frequencies, the initial capacitance for frequency 2.1 GHz being relatively small.

Figure 4:
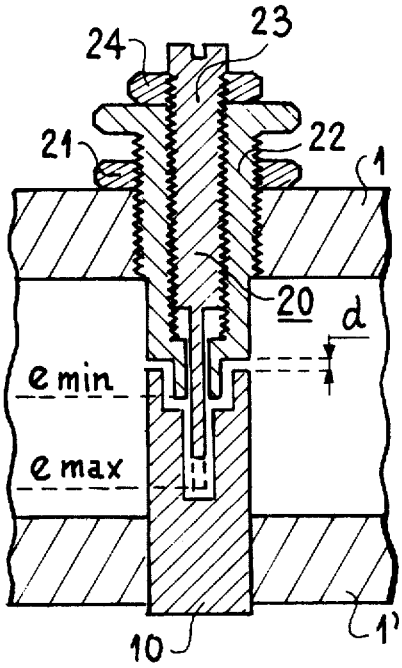
FIG. 4 is a partial cross-sectional view of another embodiment.

The embodiment of FIG. 4 makes it possible to cover a lower frequency range, the capacitance $C_{min}$ obtained for the highest frequency of the range being higher than in the embodiment of FIG. 3. For this purpose the end of hollow body 22 is cut so as to penetrate into a cavity of corresponding diameter provided in the fixed hollow finger 10. The facing planar surfaces and cylindrical surfaces of the fixed finger 10 and the body 22 of the movable finger make it possible to obtain said capacitance $C_{min}$ for the highest frequency of the range. Body 22 is then fixed by means of nut 21. The external shape of the variable capacitance tuning device in the guide does not vary in the tuning frequency range. The supplementary capacitance variation is obtained, as in the embodiments of FIGS. 2 and 3, by a small plunger 23, the fixed finger having a second hollow part, but in this case its diameter corresponds to the diameter of the small plunger. As hereinbefore, starting from a minimum penetration the tuning frequency varies in linear manner with the penetration of the tuning plunger. This embodiment made it possible to obtain a variable capacitance tuning device permitting tuning in the range 1.35 to 1.7 GHz of an evanescent mode-type ultra-high frequency filter.

Figure 5:
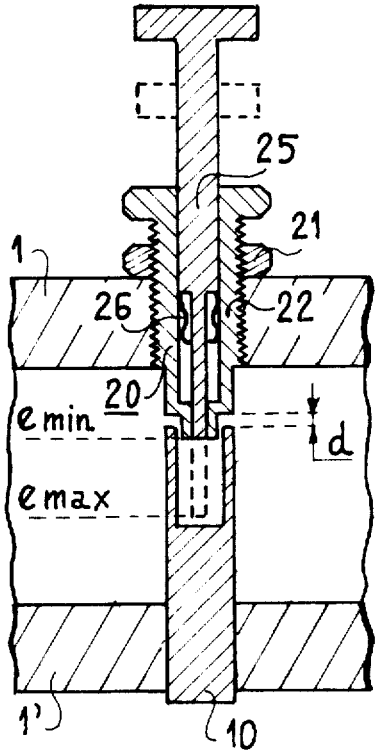
FIG. 5 is a partial cross-sectional view of another embodiment.

FIG. 5 shows an embodiment of a variable capacitance tuning device more particularly intended for so-called mobile-frequency filters, i.e. which can rapidly pass from one tuning frequency to another in a given range. The fixed finger 10, the body 22 of the movable finger and the nut 21 connected thereto are the same as in the embodiment of FIG. 2, except that the interior of body 22 is smooth and not threaded. However, the movable plunger 25 is in the form of a smooth piston able to slide in hollow body 22. Electrical contact between piston 22 and the body of the ultra-high frequency filter is obtained by means of body 22 using an end fitting 26 forming clips and extending the intermediate part of piston 25.

As in the embodiments described hereinbefore no matter what the tuning frequency the external shape of the variable capacitance tuning device does not vary. Therefore throughout the tuning frequency range the coupling of the resonator to the adjacent resonator or to the filter inputs does not vary as a function of the tuning frequency. In the same way the pass band is almost independent of the tuning frequency.

It should also be noted that the embodiments of the variable capacitance tuning device described hereinbefore lead to filters whose temperature can be very easily compensated. Thus, as the tuning frequency variation is a linear function of the penetration of the tuning plunger and as the elongations of the different mechanical components forming the capacitive elements also follow linear laws, the materials and dimensions of the elements with respect to one another can be chosen in a relatively simple manner in such a way that the temperature compensation of the filter can be obtained throughout the tuning range. Thus, the overvoltage factor remains high throughout the frequency range of the filter. Due to the fact that the small plunger has a small diameter compared with the external diameter of the two fingers, the plunger travel is large compared with the previous embodiments and this greatly facilitates adjustment of the filter. In addition, the resolution is greatly improved.

The invention is not limited to the embodiments described and represented. In particular the external shapes of the fixed and movable fingers are not limited to those described in exemplified manner with reference to FIGS. 1, 2, 3 and 4 (FIG. 5 adopting the shape shown in FIG. 2). The shapes are determined on the basis of the minimum capacitance to be obtained, particularly in conjunction with the diameter of the fingers and the dimensions of the guides in which the tuning devices are placed for producing the filters.

Moreover, in the case of frequency-mobile filters it is possible to use a small movable plunger in the form of a piston, as described relative to FIG. 5, in place of the movable plunger 23 used in the embodiments of FIGS. 2, 3 and 4 for producing frequency-mobile filters with higher or lower frequency ranges.

Furthermore, in all the embodiments described, the fixed finger has always been the hollow finger, whereas the finger which is movable in the filter body has been the finger with the tuning plunger. It is obviously possible to reverse this, the movable finger with respect to the filter body then being the hollow finger and the fixed finger then being the finger with the tuning plunger, the latter then moving in a fixed finger.

The tunable ultra-high frequency filter comprising at least one such variable capacitance tuning device can be a filter of the evanescent mode wave guide type or a filter of the TEM line type with localised capacitive elements.

What is claimed is:

1. A tunable ultra-high frequency filter comprising at least one variable capacitance tuning device incorporating first and second coaxial fingers fitted up in the filter, the first finger being a hollow cylindrical body having an external diameter with an end face at least partly flat, and the second finger comprising a cylindrical body having the same external diameter with an end face at least partly flat, extended with a plunger having a diameter much smaller than the external diameter of the cylindrical bodies which is displaceable relative to the first finger between a minimum and a maximum penetration positions where the plunger and the hollow body of the first finger have minimum and maximum facing surfaces for determining a first capacitance variation, said two cylindrical bodies being displaceable relative to one another, the variable distance between the corresponding flat faces determining a second capacitance variation.

2. A filter according to claim 1, wherein the second finger formed by a cylindrical body and plunger is in one piece, the displacement of the plunger relative to the first finger being obtained by displacing one of the two fingers in the filter, the first and second capacitance variations being linked.

3. A filter according to claim 1, wherein the plunger of the second finger moves relative to the cylindrical body also hollowed of said second finger along their common axis in order to obtain the first capacitance variation, the minimum capacitance being adjusted when the plunger is in the minimum penetration position by adjusting the distance between the cylindrical bodies of the two fingers.

4. A filter according to claim 3, wherein the second finger incorporating the movable plunger is the movable finger.

5. A filter according to claim 3, wherein the first finger is the movable finger.

6. A filter according to claim 3, wherein the hollow body of the second finger has a threaded inner surface, the outer surface of the plunger also being threaded and the penetration variation being obtained by screwing the plunger into the corresponding hollow body.

7. A filter according to claim 3, wherein the inner surface of the hollow body of the second finger is smooth, the plunger having the shape of a piston able to slide in the corresponding body to obtain the penetration variation, clip contacts integral with the plunger bearing against the inner surface of the hollow body to ensure electrical contact between the plunger and the hollow body.

8. A filter according to claim 3, wherein the ends of the first and second fingers have complementary shapes, in such a way that one of the fingers penetrates the other, their facing surfaces being formed by cylindrical surfaces and planar surfaces determining by their adjustable distance, their dimensions and their shapes the minimum capacitance of the thus formed tuning device.

9. A filter according to claim 3, wherein the ends of the first and second fingers have the same shape and determine by the adjustable distance between their facing planar surfaces the minimum capacitance of the tuning device obtained in this way.

* * * * *